United States Patent [19]

O'Neal, Jr.

[11] Patent Number: 4,664,386

[45] Date of Patent: May 12, 1987

[54] GOLF COURSE

[75] Inventor: James C. O'Neal, Jr., Dallas, Tex.

[73] Assignee: American Golf, Inc., Dallas, Tex.

[21] Appl. No.: 699,336

[22] Filed: Feb. 7, 1985

[51] Int. Cl.[4] ..... A63B 67/00; A63B 67/02; A63B 57/00

[52] U.S. Cl. ..... 273/176 R; 273/178 B; 273/34 R

[58] Field of Search ..... 273/199 R, 34 B, 176 R, 273/176 A, 176 B, 180, 181 A, 178 B, 34 R

[56] References Cited

U.S. PATENT DOCUMENTS

| | | | |
|---|---|---|---|
| 3,156,470 | 11/1964 | Newkirk | 273/176 |
| 3,671,042 | 6/1972 | Garber | 273/176 |
| 4,150,826 | 4/1979 | Baldorossi et al. | 273/199 R |
| 4,189,152 | 2/1980 | Raber | 273/176 |

FOREIGN PATENT DOCUMENTS

| | | | |
|---|---|---|---|
| 220377 | 8/1924 | United Kingdom | 273/34 B |

OTHER PUBLICATIONS

"Golf World", Jul. 20, 1962, p. 15.

"Golf Digest", Nov. 1984, p. 89.

*Primary Examiner*—George J. Marlo

*Attorney, Agent, or Firm*—Hubbard, Thurman, Turner & Tucker

[57] ABSTRACT

A novel golf course is disclosed. The course includes a plurality of golf holes, each golf hole having a tee area, fairway and a putting surface or "green." The tee area is generally flat and suitable for teeing and striking a golf ball. In a preferred embodiment of the present invention, each golf hole includes multiple tee areas, each tee area disposed a different distance from the putting surface. An important feature of the present invention is the tow round putting cups of substantially different diameters which appears in the putting surface of each green on the golf course. Each cup includes means for supporting a flagstaff and a flag. Each flag preferably includes visually perceptible indications of the diameter of the cup supporting its respective flagstaff so that distant golfers may direct a golf ball at a selected cup. In a preferred embodiment of the present invention, each flag is constructed of an easily identifiable colored material.

5 Claims, 2 Drawing Figures

GOLF COURSE

BACKGROUND OF THE INVENTION

This invention relates in generally to the game of golf and in particular to a game of golf which permits players of varying skill levels to enjoy playing on the same golf course.

Golf is an outdoor game having its origins in ancient Scotland. The game consists of stroking a small hard ball over a large, grass covered course, with specially designed clubs, in the fewest number of shots. Regulation golf balls measure slightly more than one and a half inches in diameter and are usually made of rubber thread wound tightly around a liquid filled center sac or a small steel ball. The outer surface is typically made of balata or a similar rubber-like substance and is covered with dimples, or tiny circular indentations that increase the ball's distance and accuracy in flight. Although each player is allowed to have only one ball in play, he typically carries additional balls to replace those lost in water hazards or in wooded areas. A typical set of golf clubs usually includes four woods, or clubs with wooden heads for long shots and ten irons, or clubs with metal heads for shorter shorts.

A regulation golf course generally consists of eighteen golf holes, although many golf courses only incorporate nine holes. Each golf hole includes one or more tee areas from which the ball is initially struck and put into play and a "fairway" and a "green" which contains one putting cup, into which the ball is stroked to complete the hole. The common size cup is a plastic or metal container, four and a quarter inches in diameter and at least four inches deep which is generally sunk into the turf. A flagstaff and flag are generally provided and centered in the cup to permit the cup's location to be observed from great distances. In addition to the smallness of the cup, the "green" or putting surface which surrounds the cup usually includes small rises and dips which tend to make it more difficult to putt or stroke the ball into the cup. As a result, the game of golf is generally putting oriented, with the average golfer utilizing over forty percent of his total strokes in putting on the green.

Between the tee area and the putting surface is a large expanse of trimmed lawn known as the fairway. The fairway is typically surrounded on either side by unmowed grass known as the "rough". Generally natural barriers such as bodies of water and wooded areas are incorporated into the design of a golf course. Additionally, man-made obstacles such as sandtraps and built-up areas are generally placed along the fairway and near the green.

"Par" is the term utilized in golf scoring which refers to the number of strokes an expert golfer should require to complete each golf hole, allowing two strokes to putt the ball into the cut on the green. Par is usually determined by officials of each course and usually varies from three strokes to five strokes per golf hole. Approximately 17 million Americans play golf annually on over 12,000 American golf courses. Of this large number of golfers, only about 14,000 are professional golfers who generally shoot par or below par, while approximately 13 million golfers shoot 16 to 48 over par.

In order to permit the vast majority of American golfers to more thoroughly enjoy a round of golf, a manner must be found to develop a game that is more in harmony with the skill and ability of these 13 million golfers. Since the largest percentage of golf shots in an average round are putting strokes, an invention for minimizing the number of putting strokes utilized would greatly enhance the average player's enjoyment of a round of golf, plus would reduce the amount of time necessary to complete a round of golf.

SUMMARY OF THE INVENTION

It is therefore one object of the present invention to provide an improved golf course.

It is another object of the present invention to provide an improved golf course which permits fewer strokes to be utilized.

It is yet another object of the present invention to provide an improved golf course which permits a round of golf to be played in a shorter period of time.

It is another object of the present invention to provide an improved golf course which permits a golfer of less than expert skill to more thoroughly enjoy playing the course.

It is still another object of the present invention to provide an improved golf course which will permit golfers of varying skill levels to enjoy the same golf course.

The foregoing objects are achieved as is now described. The golf course of the present invention includes a plurality of golf holes, each having a tee area, fairway and putting surface or "green." The tee area is generally flat suitable for teeing and striking a golf ball into initial play. In a preferred embodiment of the present invention, each golf hole includes multiple tee areas, each tee area disposed a different distance from the putting surface to permit golfers of varying skill levels to begin play in a different area. An important feature of the present invention is the use of two circular putting cups of substantially different diameters that are placed on the putting surface of the greens on each golf hole. Each cup includes means for supporting a flagstaff and flag. Each flag preferably includes visually perceptible indications of the diameter of the cup supporting its respective flagstaff so that distant golfers may direct a golf ball at a selected diameter cup. In a preferred embodiment of the present invention, flags are constructed of easily identifiable colored material to permit visual identification to take place.

BRIEF DESCRIPTION OF THE DRAWINGS

The novel features believed to be characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings wherein:

DETAILED DESCRIPTION OF THE PREFERRED EMBODIMENT

Figure 1:
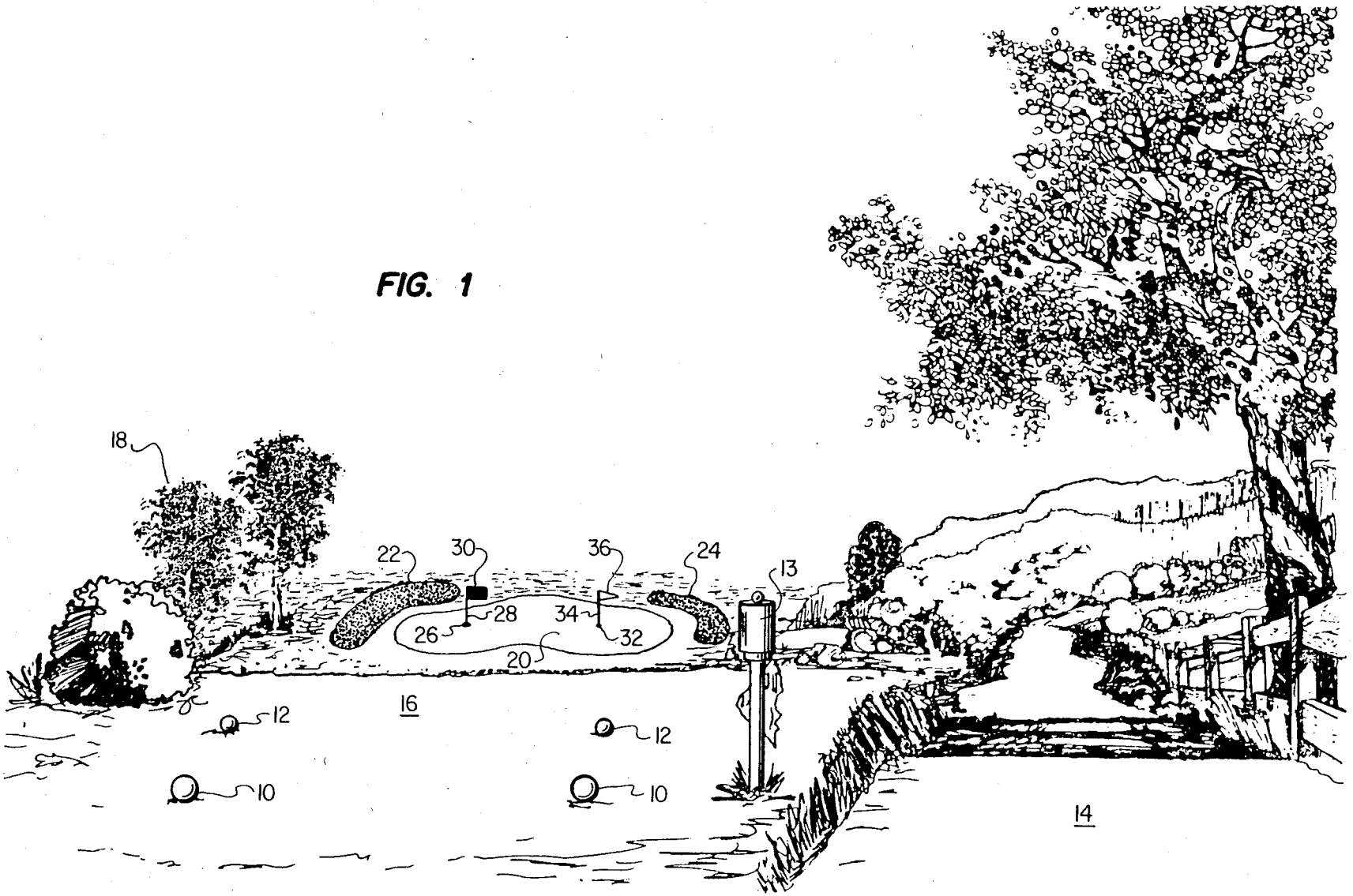
FIG. 1 is a perspective view of a single golf course hole on the novel golf course of the present invention.

With reference now to the figures, and in particular with reference to FIG. 1, there is depicted a perspective view of a single golf course hole of the novel golf course of the present invention. As can be seen in FIG. 1, the golf course hole depicted includes a pair of tee markers 10 and a second pair of tee markers 12. This particular construction is common in American golf courses and permits golfers of varying skills to tee off at points which are various distances from the green. Also depicted in FIG. 1 are cart path 14 and ball washer 13, accoutrements typically found at modern American golf courses.

Fairway 16, a long expanse of closely trimmed grass, extends from tee markers 10 and 12 and toward green 20. As can be seen, fairway 16 may be bordered by wooded area 18 or other natural hazards which serve to enhance the challenging nature of a typical golf course.

Disposed distant from tee markers 10 and 12 is puting surface or "green" 20. Adjacent to putting surface 20 are sand traps 22 and 24 which, together with other man made obstacles, are typically placed surrounding the golf course putting surfaces to guard approaches thereto and enhance the difficulty of the course. As can be seen, putting surface 20 includes cups 26 and 32, each of which have substantially different diameters, and each of which serves to support a flagstaff, 28 and 34 respectively. Flagstaffs 28 and 34 serve to mount flags 30 and 36, which in the preferred embodiment of the present invention include visually perceptible differences which permit golfers located a substantial distance away from putting surface 20 to differentiate between cup 26 and cup 32. In a preferred embodiment of the present invention, flags 30 and 36 are constructed utilizing fabrics of substantially different colored material so that the distance at which cup 26 may be distinguished from cup 32 is quite great.

Figure 2:
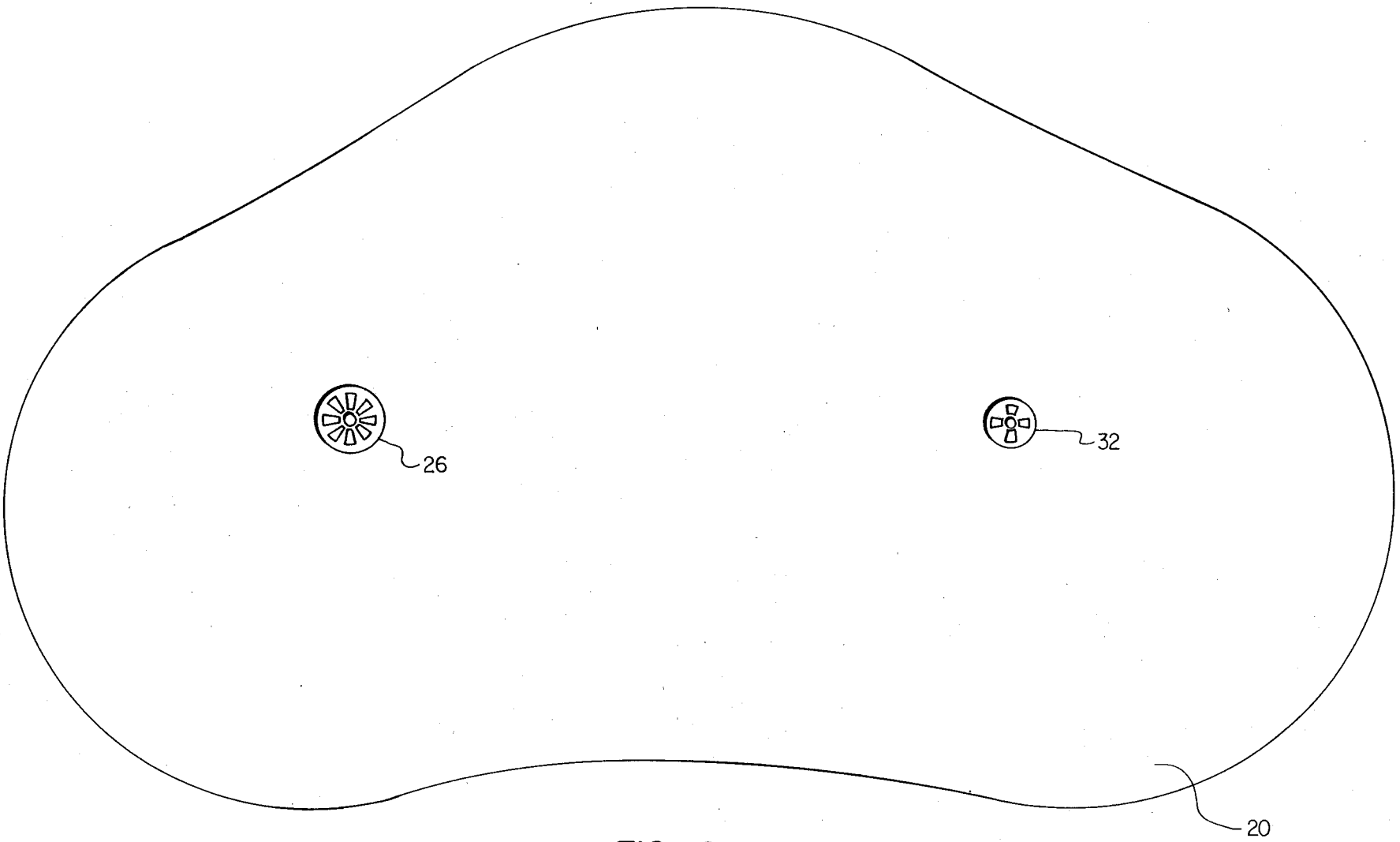
FIG. 2 is a plan view of the surface of the golf gren of the golf course hole depicted in FIG. 1.

With reference now to FIG. 2, there is depicted a plan view of putting surface 20 of the golf hole depicted in FIG. 1. As can be seen, cup 26 has a diameter substantially greater than cup 32. In a preferred embodiment of the present invention, cup 32 is a golf cup size that has been commonly used on golf courses and is approximately four and one quarter inches in diameter and four inches deep. Cup 32 may be constructed of plastic or metal and generally includes means for supporting flagstaff 34 at the center thereof. In the depicted embodiment of the present invention, cup 26 is approximately six inches in diameter and four inches deep and also may be constructed of plastic or metal. Additionally, cup 26 also includes means for supporting flagstaff 28 at the center thereof.

By utilizing a diameter of approximately six inches, cup 26 greatly enhances the average golfer's enjoyment of the game of golf by permitting him to sink a larger percentage of his putts. For example, it has been calculated that a golfer with average putting skills should make greater than eighty percent of all four foot putts utilizing a six inch diameter cup. As a further example, many professional golfers have missed many putts to the four and one quarter in cup from distances as short as eighteen to twenty-four inches.

By utilizing the novel golf course of the present invention in which two substantially different diameter cups are present on each golf green, the average golfer may enjoy his game more by putting at a less demanding target while the superior skill golfer can continue to play golf utilizing the traditional four and one quarter inch diameter cup. It is anticipated that each golfer will determine which size cup will be utilized during his or her round of golf while at the first tee. That particular size cup will then be utilized throughout the round of golf. In this manner, along with the visually perceptible flags which permit a distant golfer to direct a shot at either cup, a single golf course may be simultaneously enjoyed by players of varying skill levels without the necessity for special clubs or different courses for each different skill level. Additionally, extensive study utilizing the depicted embodiment of the present invention has determined that a round of golf may be completed in substantially less time when utilizing the larger diameter cup, even when some players on the course are utilizing the traditional four and one quarter inch diameter cup. This also greatly enhances the average golfer's enjoyment of a round of golf as well as contributing to the enjoyment of a skilled golfer utilizing the smaller diameter cups since total playing time is reduced with the novel design of the present invention.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A large outdoor regulation size golf course on which the game of golf may be played with regulation golf balls measuring slightly more than one and a half inches of diameter and having a plurality of grass covered golf holes, each golf hole comprising:

a tee area for initiating play on each golf hole, said tee area having a generally flat area suitable for teeing and striking a golf ball;

a putting surface disposed distant from said tee area, said putting surface having a surface and texture suited to receive golf balls and permitting putting thereon;

a fairway area extending between said tee area and said putting surface;

a first cup for receiving golf balls disposed within said putting surface; and a second cup for receiving golf balls disposed within said putting surface, said second cup having a diameter substantially greater than the diameter of said first cup whereby golfers playing golf balls having essentially the same diameters may select said first cup of said second cup for use during play to increase or decrease the difficulty of said golf course.

2. A golf course according to claim 1 wherein said first cup is approximately four and one quarter inches in diameter.

3. A golf course according to claim 1 wherein said second cup is approximately six inches in diameter.

4. A large outdoor regulation size golf course on which the game of golf may be played with regulation golf balls measuring slightly more than one and a half inches in diameter and having a plurality of grass covered golf holes, each golf hole comprising:

a tee area for initiating play on each golf hole, said tee area having a generally flat area suitable for teeing and striking a golf ball;

a putting surface disposed distant from said tee area, said putting surface having a surface and texture suited to receive golf balls and permitting putting thereon;

a fairway area extending between said tee area and said putting surface;

a first cup for receiving golf balls disposed within said putting surface and having means for receiving and supporting a flagstaff;

a first flagstaff disposed within said first cup and supporting a first flag;

a second cup for receiving golf balls disposed within said putting surface and having means for receiving and supporting a second flagstaff, said second cup having a diameter substantially greater than the diameter of said first cup whereby golfers playing golf balls having essentially the same diameters may select said first cup or said second cup for use during play to increase or decrease the difficulty of said golf course; and a second flagstaff disposed within said second cup and supporting a second flag, said second flag having a substantially different appearance from said first flag whereby golfers may select said first cup or said second cup for use during play at a substantial distance from said putting surface.

5. A golf course according to claim 4 wherein said first flag and said second flag are constructed of different colored materials.

* * * * *